US011031224B2

(12) United States Patent
Wang et al.

(10) Patent No.: US 11,031,224 B2
(45) Date of Patent: Jun. 8, 2021

(54) ION GUIDING DEVICE AND GUIDING METHOD

(71) Applicant: SHIMADZU CORPORATION, Kyoto (JP)

(72) Inventors: Keke Wang, Shanghai (CN); Xiaoqiang Zhang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/500,467

(22) PCT Filed: May 30, 2017

(86) PCT No.: PCT/JP2017/019992
§ 371 (c)(1),
(2) Date: Oct. 3, 2019

(87) PCT Pub. No.: WO2018/198386
PCT Pub. Date: Nov. 1, 2018

(65) Prior Publication Data

US 2020/0126777 A1 Apr. 23, 2020

(30) Foreign Application Priority Data

Apr. 28, 2017 (CN) ..... 201710295140.X

(51) Int. Cl.
*H01J 49/00* (2006.01)
*H01J 49/06* (2006.01)
*H01J 3/14* (2006.01)

(52) U.S. Cl.
CPC ..... *H01J 49/066* (2013.01); *H01J 3/14* (2013.01); *H01J 49/068* (2013.01)

(58) Field of Classification Search
CPC .. H01J 49/00; H01J 49/02; H01J 49/06; H01J 49/062; H01J 49/063; H01J 49/065; H01J 49/066
(Continued)

(56) References Cited

U.S. PATENT DOCUMENTS 2,235,497 A 3/1941 Heil
3,308,323 A 3/1967 Van De Graaff
(Continued)

FOREIGN PATENT DOCUMENTS

CN 101606220 A 12/2009
CN 103165360 A 6/2013
(Continued)

OTHER PUBLICATIONS

SIPO, "1st Chinese Office Action and Search Report for Chinese Application No. 201710295140.X", China, dated Aug. 2, 2019.
(Continued)

*Primary Examiner* — Jason L McCormack
(74) *Attorney, Agent, or Firm* — Tim Tingkang Xia, Esq.; Locke Lord LLP

(57) ABSTRACT

An ion guiding device includes ring electrodes with a same size disposed in parallel; wherein a connection line of centers of the ring electrodes is defined as an axis, a normal of a plane where any of the ring electrodes is located and a tangent line of the axis at a center of the ring electrode form an included angle being a range of (0, 90) degrees; a radio-frequency voltage source, for applying an out-phase radio-frequency voltage on a neighboring ring electrode along the axis, so that ions are confined inside the ring electrode during a transmission process; and a direct-current voltage source, applying a direct-current voltage with an amplitude changing along the axis on the ring electrode, so that the ions are transmitted along the axis and focused to a
(Continued)

position closer to an inner surface of the ring electrode along a direction of the normal.

12 Claims, 6 Drawing Sheets

(58) Field of Classification Search
USPC ..... 250/281, 282
See application file for complete search history.

(56) References Cited

U.S. PATENT DOCUMENTS

| | | | | |
|---|---|---|---|---|
| 5,120,956 | A | 6/1992 | Purser | |
| 6,107,628 | A | 8/2000 | Smith et al. | |
| 7,781,728 | B2 | 8/2010 | Senko et al. | |
| 8,581,181 | B2 | 11/2013 | Giles | |
| 2004/0046124 | A1 | 3/2004 | Derrick et al. | |
| 2005/0178973 | A1 | 8/2005 | Derrick et al. | |
| 2008/0308721 | A1* | 12/2008 | Senko ..... | H01J 49/065 250/281 |
| 2009/0045062 | A1* | 2/2009 | Senko ..... | H01J 49/066 204/547 |
| 2011/0049357 | A1 | 3/2011 | Giles | |
| 2013/0140468 | A1 | 6/2013 | Chen | |
| 2015/0206731 | A1 | 7/2015 | Zhang et al. | |
| 2015/0364313 | A1* | 12/2015 | Zhang ..... | H01J 49/065 250/288 |
| 2016/0163525 | A1 | 6/2016 | Green et al. | |

FOREIGN PATENT DOCUMENTS

| | | | |
|---|---|---|---|
| CN | 104170053 | A | 11/2014 |
| JP | 2010530120 | A | 9/2010 |

OTHER PUBLICATIONS

SIPO, "2nd Chinese Office Action for Chinese Application No. 201710295140.X", China, dated Apr. 23, 2020.

EPO (ISR/EP), "International Search Report and Written Opinion for PCT Application No. PCT/JP2017/019992", NL, dated Mar. 20, 2018.

SIPO, "3rd Chinese Office Action for Chinese Application No. 201711:1295140.X", China, dated Jan. 20, 2021.

* cited by examiner

[Fig. 1]
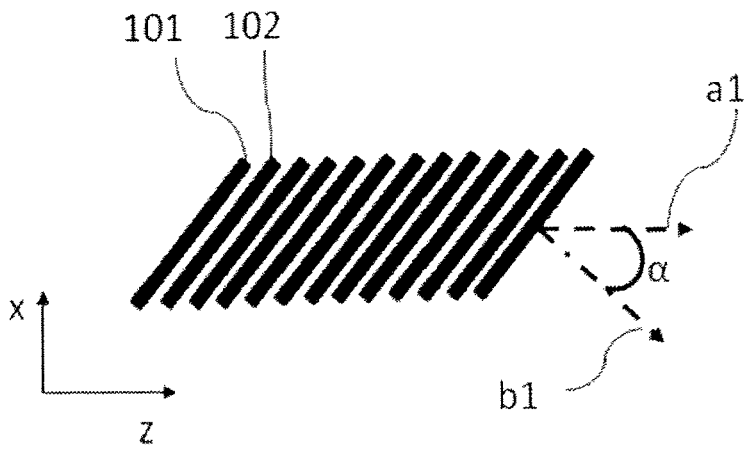
[Fig. 2]
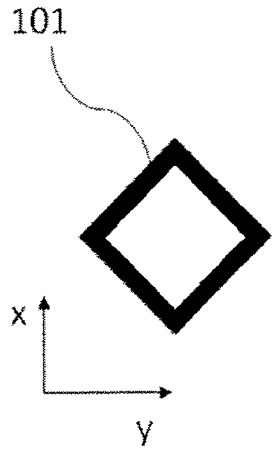
[Fig. 3(a)]
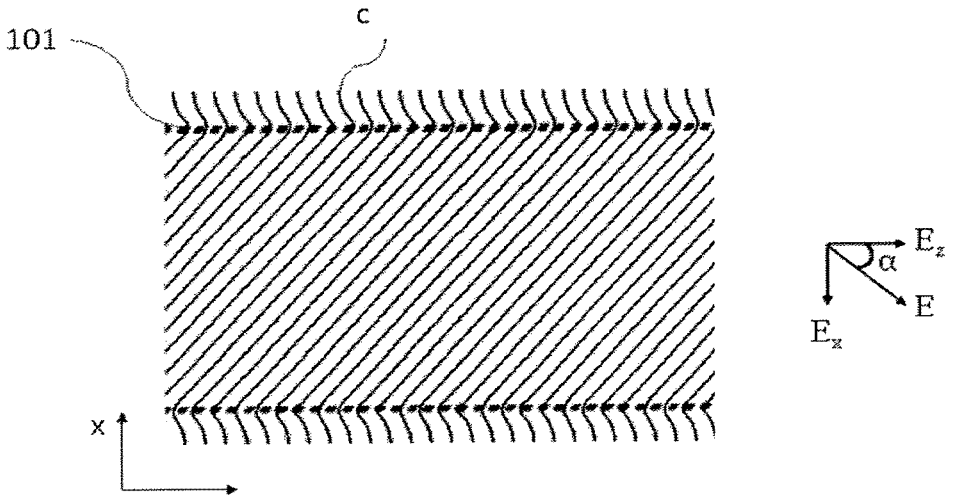

[Fig. 3(b)]
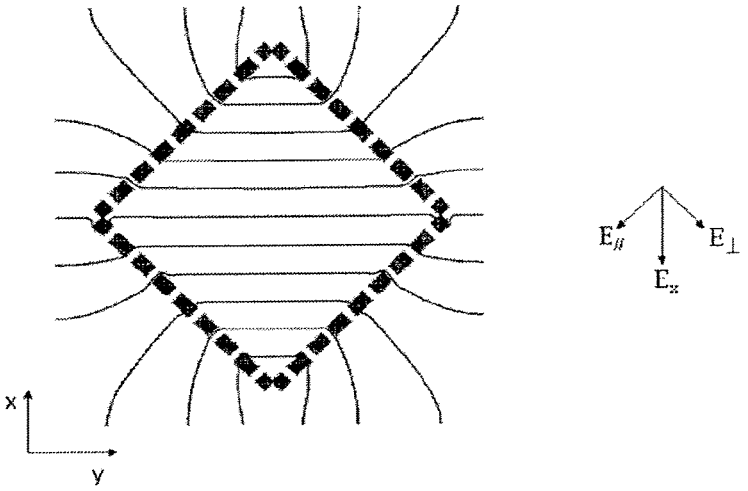
[Fig. 4(a)]
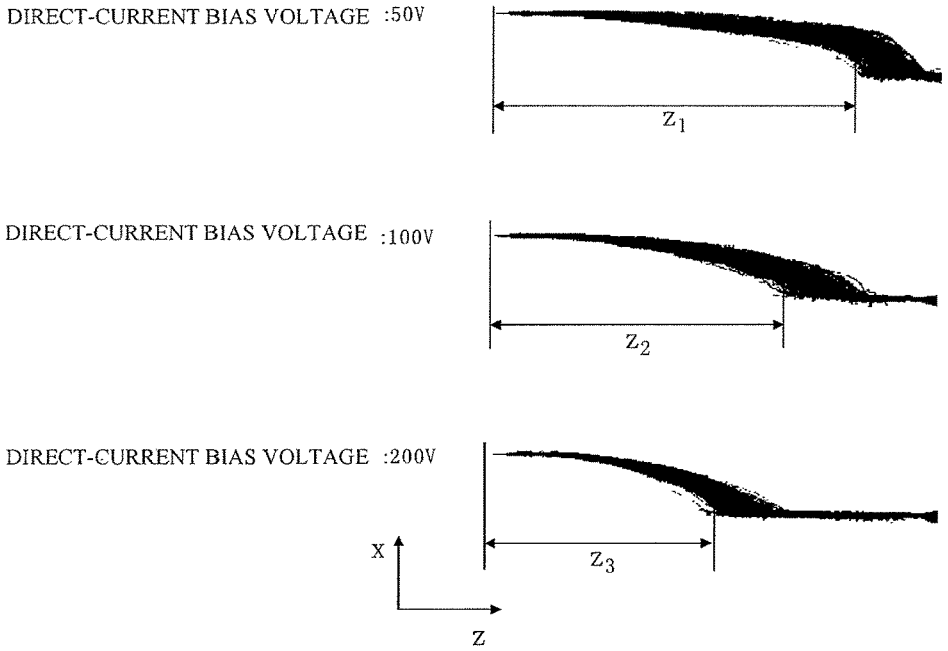
[Fig. 4(b)]
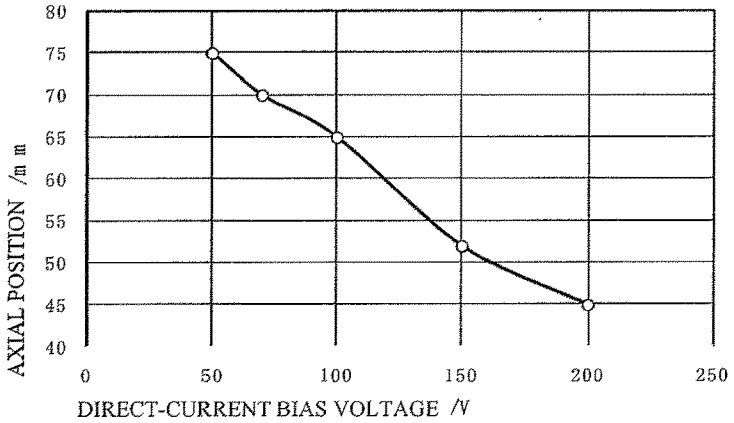

[Fig. 5]
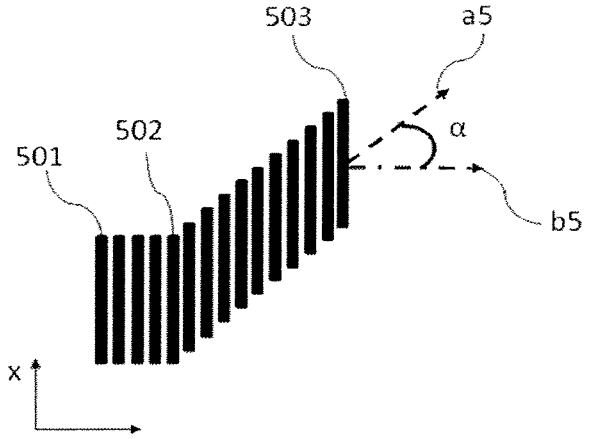
[Fig. 6]
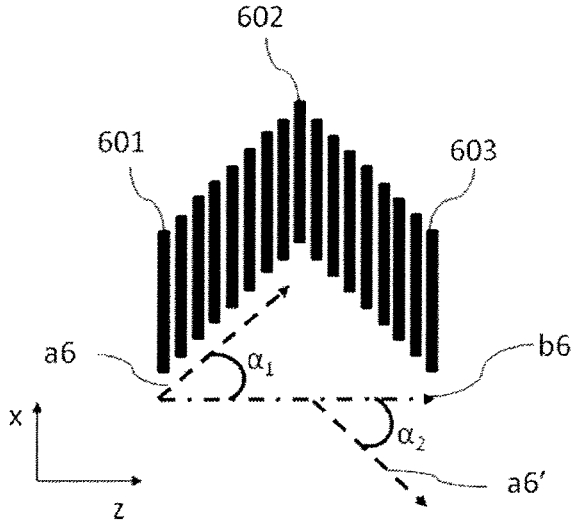
[Fig. 7]
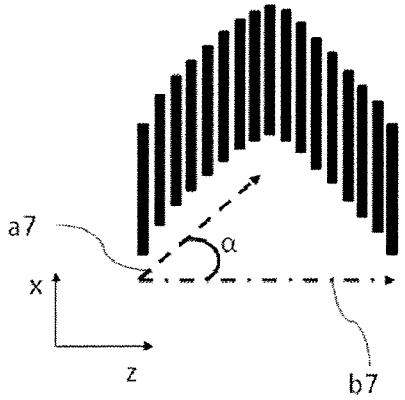

[Fig. 8]
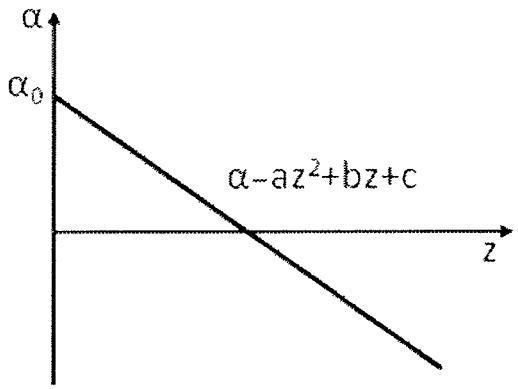
[Fig. 9]
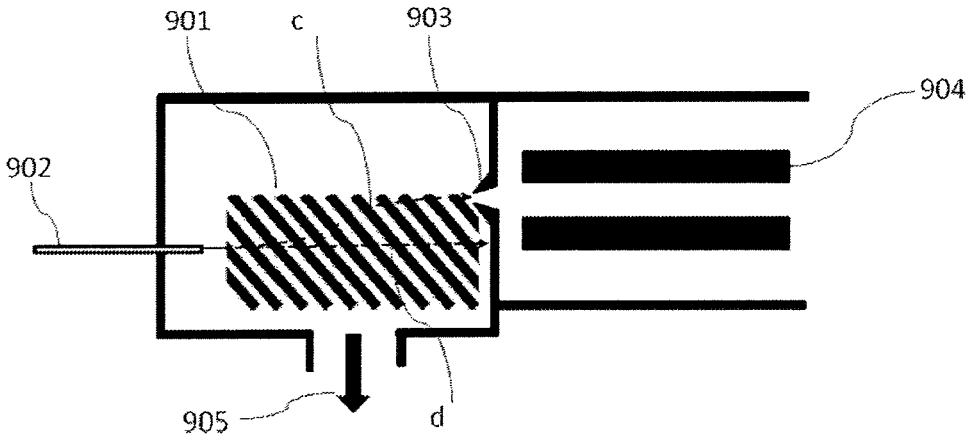
[Fig. 10]
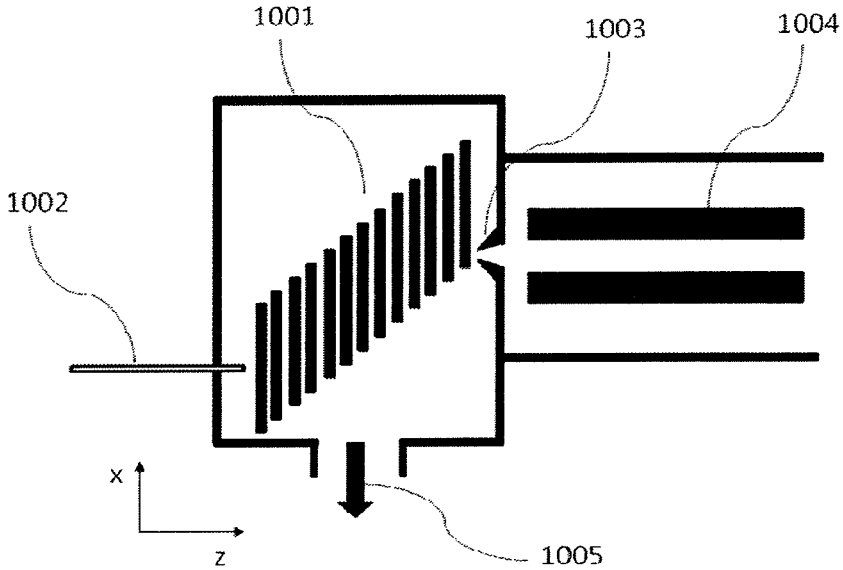

[Fig. 11(a)]
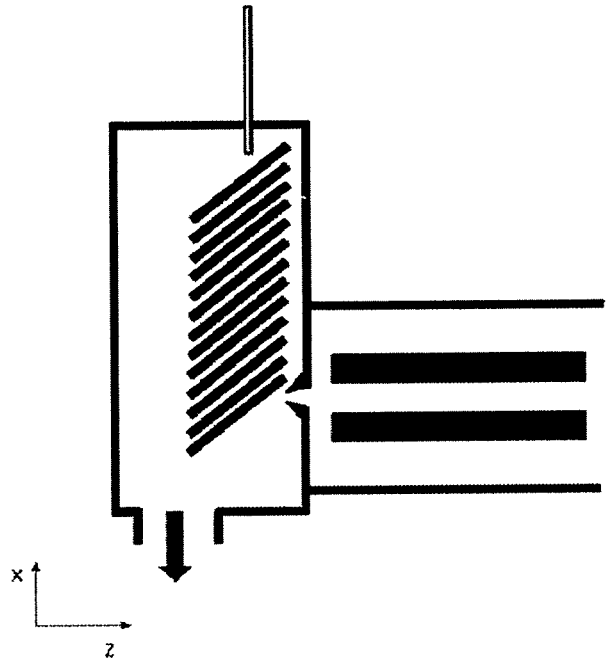
[Fig. 11(b)]
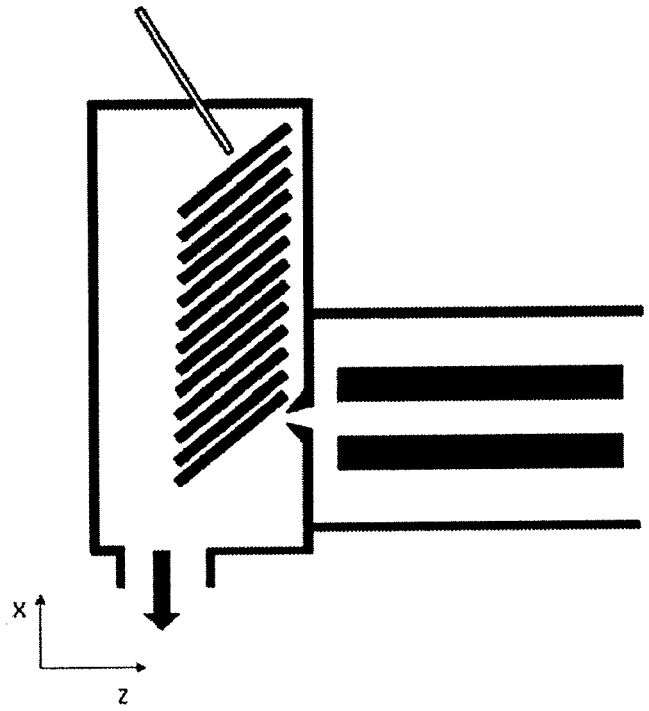

[Fig. 11(c)]
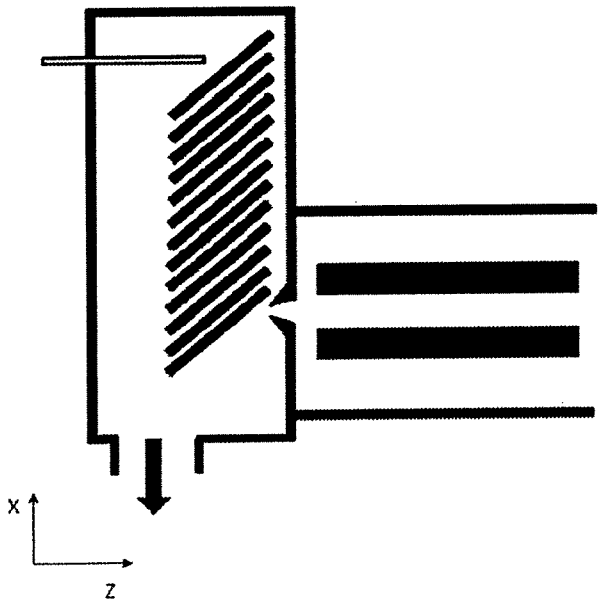
[Fig. 12]
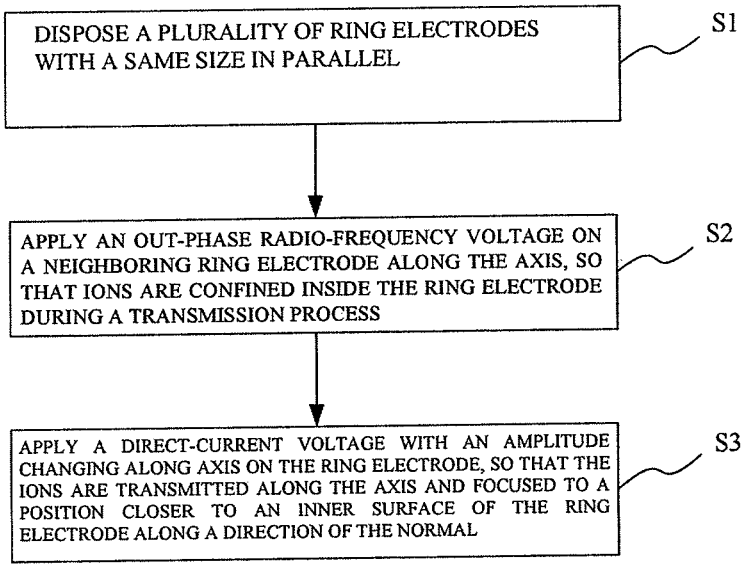

ION GUIDING DEVICE AND GUIDING METHOD

CROSS-REFERENCE TO RELATED PATENT APPLICATIONS

This application is a U.S. national stage entry of PCT Application Serial No. PCT/JP2017/019992, filed May 30, 2017, which claims priority to and the benefit of, Chinese Patent Application Serial No. 201710295140.X, filed Apr. 28, 2017, which are incorporated herein by reference in their entireties.

FIELD OF THE INVENTION

The present invention relates to an ion guiding device and guiding method, and in particular, to an ion guiding device and guiding method for guiding ions for off-axis transmission, focusing, and entering a rear stage for mass spectrometry analysis at a high pressure or a low vacuum.

BACKGROUND OF THE INVENTION

A liquid chromatograph-mass spectrometer (LCMS) generally adopts an atmospheric pressure ion source, for example, an electrospray ion source. Ions generated by the ion source require to be transmitted from an atmospheric area to an ion analyzer area with a low pressure (for example, a pressure less than 1 Pa). In addition to essential vacuum interfaces during the transmission process, an ion guiding device is generally required.

The ion guiding device generally consists of a series of electrodes applied a radio-frequency voltage. The radio-frequency voltage forms an effective barrier around a central axis of the device for confining the ions, which prevents ion losses and obtains high transmission efficiency. Ring electrode array (stacked ring) is a form of ion guiding devices. This type of device consists of a series of ring electrodes arranged along an axis, the radio-frequency voltage with the same amplitude and opposite phase is applied between neighboring electrodes, to confine the ions in a radial direction, and meanwhile, a direct-current voltage or travelling wave voltage is applied along the axis to drive the ions. This type of device is widely used in commercial instrument due to advantages such as wide mass range, strong radio-frequency confining closer to a surface of an electrode, and adaptive to a high pressure. In early days, this type of device uses ring electrodes with equal diameters and equal spaces to be arranged along the axis, for only transmitting narrow ion beams, and it has a limited receiving area and cannot focus the ion beam.

A US patent with publication No. U.S. Pat. No. 6,107,628A provides an ion funnel technique, which uses a ring electrode array with gradually reduced diameters, thereby obtaining a relative large area for receiving the ions while achieving effect focusing of the ion beam. Currently, the device achieves success in commercial instrument.

A US patent with publication No. U.S. Pat. No. 7,781,728B2 adopts another technique to achieve similar purposes. In this technique, ring electrodes with equal diameters are adopted, and by gradually increasing the space between the electrodes, the radio-frequency barrier gradually moves towards the center of the ring electrodes, thereby focusing the ions. It should be noted that the transmission efficiency will be decreased in a high pressure (for example, 10 torr or higher) in this device or strong ion confining is required. This is because a large space between the electrodes would enable lower the radio-frequency barrier closer to the electrodes. Furthermore, another problem is mass discrimination.

A US patent with publication No. U.S. Pat. No. 8,581,181B2 and related patents adopt two sets of ring electrode arrays with different diameters to be coupled with each other radially, the difference of the direct-current voltage guides the ions to enter the ring electrode array with a smaller diameter from the ring electrode array with a larger diameter, thereby achieving ion focusing, to obtain high ion intensity and reduce the neutral noises.

A US patent with publication No. US20150206731A1 provides another method, comprising dividing each ring electrode into two sections, wherein the length ratio changes gradually along the axis, and the direct-current voltage difference applied between the sections can guide the ions from the larger section electrode to the surface of the smaller section electrode, thereby focusing the ions.

However, the various prior art obtains ion focusing by changing a certain parameter of the ring electrode, such as diameter, space, and section ratio. Moreover, the changed electrode parameter increases complexity of processing or assembling of the electrode.

SUMMARY OF THE INVENTION

In view of the defects of the prior art, the purpose of the present invention is to provide an ion guiding device and guiding method, by disposing a plurality of ring electrodes with the same size in parallel and in an equal distance, ion focusing at a high pressure or a low vacuum is effectively achieved, and neutral noises are effectively removed while greatly reducing difficulties in processing, manufacturing and assembling.

In order to achieve the aforementioned purpose and other related purposes, the present invention provides an ion guiding device, which comprises a plurality of ring electrodes with a same size disposed in parallel; wherein the connection line of centers of the plurality of ring electrodes is defined as the axis, the normal of a plane where any of the ring electrodes is located and the tangent line of the axis at the center of the ring electrode form an included angle, and the range of the included angle is (0, 90) degrees; a radio-frequency voltage source, for applying an out-phase radio-frequency voltage on a neighboring ring electrode along the axis, so that ions are confined inside the ring electrode during transmission; and a direct-current voltage source, applying a direct-current voltage with an amplitude changing along the axis on the ring electrode, so that the ions are transmitted along the axis and focused to a position closer to an inner surface of the ring electrode along a direction of the normal.

In an embodiment of the present invention, the ring electrode is circular, oval or polygonal.

In an embodiment of the present invention, the axis is straight line, curve or polygonal line.

In an embodiment of the present invention, the amplitude of the direct-current voltage is changed in a nonlinear manner along the axis.

In an embodiment of the present invention, it further comprises an ion injection device for injection ions to the ion guiding device, and an included angle between an ion introducing direction and the direction of the normal ranging between [0, 90] degrees.

In an embodiment of the present invention, it further comprises an ion ejection device for ejection the focused ions from the ion guiding device, and an included angle between an ion ejection direction and the direction of the normal ranging between [0, 90] degrees.

In an embodiment of the present invention, it further comprises air pump device, for pumping neutral components around the plurality of ring electrodes.

In an embodiment of the present invention, it further comprises several ring electrodes disposed at ion injection ends of the plurality of ring electrodes, wherein the several ring electrodes are disposed in parallel to the plurality of ring electrodes, and an included angle between a normal of a plane where the several ring electrodes are located and a tangent line of the axis at a center of the ring electrodes is 0 degree.

Meanwhile, the present invention further provides an ion guiding method, which comprises the following steps:

disposing a plurality of ring electrodes with a same size in parallel; defining a connection line of centers of the plurality of ring electrodes as an axis, and forming an included angle between a normal of a plane where any of the ring electrodes is located and a tangent line of the axis at a center of the ring electrode, wherein the range of the included angle is (0, 90) degrees;

applying an out-phase radio-frequency voltage on a neighboring ring electrode along the axis, so that ions are confined inside the ring electrode during transmission; and applying a direct-current voltage with an amplitude changing along the axis on the ring electrode, so that the ions are transmitted along the axis and focused to a position closer to an inner surface of the ring electrode along a direction of the normal.

In an embodiment of the present invention, it further comprises: injection ions to the ion guiding device, and an included angle between an ion injection direction and the direction of the normal ranging between [0, 90] degrees.

In an embodiment of the present invention, it further comprises: ejection the focused ions from the ion guiding device, and an included angle between an ion ejection direction and the direction of the normal ranging between [0, 90] degrees.

In an embodiment of the present invention, it further comprises: disposing several ring electrodes at ion injection ends of the plurality of ring electrodes, wherein the several ring electrodes are disposed in parallel to the plurality of ring electrodes, and an included angle between a normal of a plane where the several ring electrodes are located and a tangent line of the axis at a center of the ring electrodes is 0 degree.

As stated above, the ion guiding device and guiding method of the present invention have the following beneficial effects:

(1) By disposing the plurality of ring electrodes with the same size in parallel, ion focusing at a high pressure or a low vacuum is effectively achieved;

(2) By the off-axis transmission of the ions, neutral noises are effectively reduced; and (3) The complexity in processing, manufacturing and assembling are greatly reduced and strong utility is provided.

BRIEF DESCRIPTION OF THE DRAWINGS

FIG. 1 shows a structural schematic diagram of a first embodiment of an ion guiding device of the present invention.

FIG. 2 shows a structural schematic diagram of a front view of a ring electrode in the first embodiment of the ion guiding device of the present invention.

FIG. 3(*a*) shows an equipotential line distribution diagram of an xz cross section in the first embodiment of the ion guiding device of the present invention.

FIG. 3(*b*) shows an equipotential line distribution diagram of an xy cross section in the first embodiment of the ion guiding device of the present invention.

FIG. 4(*a*) shows a simulation schematic diagram of ion trajectory under different direct-current bias voltages in the first embodiment of the ion guiding device of the present invention.

FIG. 4(*b*) shows a schematic diagram of a relation between the direct-current bias voltage and the axial position in the first embodiment of the ion guiding device of the present invention.

FIG. 5 shows a structural schematic diagram of a second embodiment of the ion guiding device of the present invention.

FIG. 6 shows a structural schematic diagram of a third embodiment of the ion guiding device of the present invention.

FIG. 7 shows a structural schematic diagram of a fourth embodiment of the ion guiding device of the present invention.

FIG. 8 shows a schematic diagram of a change in a value of an included angle $\alpha$ along with a z axis in the ion guiding device of the present invention.

FIG. 9 shows a structural schematic diagram of a fifth embodiment of the ion guiding device of the present invention.

FIG. 10 shows a structural schematic diagram of a sixth embodiment of the ion guiding device of the present invention.

FIG. 11(*a*) shows a structural schematic diagram of a seventh embodiment of the ion guiding device of the present invention.

FIG. 11(*b*) shows a structural schematic diagram of the seventh embodiment of the ion guiding device of the present invention.

FIG. 11(*c*) shows a structural schematic diagram of the seventh embodiment of the ion guiding device of the present invention.

FIG. 12 shows a flow chart of an ion guiding method of the present invention.

DETAILED DESCRIPTION OF THE INVENTION

Implementing modes of the present invention are explained by means of specific detailed embodiments. A person skilled in the art can easily understand other advantages and effects of the present invention according to the disclosure of the present specification.

It should be noted that, the structure, scale, size, etc., drawn in the drawings of the specification all are only used to cooperate with the disclosure of the specification to be understood and read by a skilled person in this field, rather than limiting the defining conditions that can be implemented by present invention, and therefore, do not have substantive means in technology. Any modification of structure, change in scale relation or adjustment of size should fall within the scope that can be covered by the technical contents disclosed in the present invention without influencing the effects that can be generated and the purposes that can be achieved in the present invention. Meanwhile, terms used in the present specification, such as, "upper", "lower", "left", "right", "middle", and "a/an", are only used for clarity in description, rather than limiting the scope that can be implemented by the present invention. A change or adjustment in a relative relation thereof should also be considered as a scope that can be implemented by the present invention without a substantively changed technical content.

The ion guiding device and guiding method of the present invention comprise a plurality of ring electrodes with a same size disposed in parallel and in an equal distance; wherein a connection line of centers of the plurality of ring electrodes is defined as an axis, a normal of a plane where any of the ring electrodes is located and a tangent line of the axis at a center of the ring electrode form an included angle, and a range of the included angle is (0, 90) degrees; a radio-frequency voltage source, for applying an out-phase radio-frequency voltage on a neighboring ring electrode along the axis, so that ions are confined inside the ring electrode during transmission; and a direct-current voltage source, applying a direct-current voltage with an amplitude changing along the axis on the ring electrode, so that the ions are transmitted along the axis and focused to a position closer to an inner surface of the ring electrode along a direction of the normal. The ion guiding device and guiding method of the present invention can achieve ion transmission and focusing at a certain vacuum degree, and ions off-axis transmission to reduce the noises of the neutral components, while greatly reducing difficulties in processing, manufacturing and assembling.

The ion guiding device of the present invention will be illustrated by means of the specific embodiments in detail as follows.

Embodiment 1

As shown in FIG. 1, in Embodiment 1 of the present invention, the ion guiding device comprises:

A plurality of ring electrodes (101, 102 . . . ) with the same size disposed in parallel, wherein a connection line of centers of the plurality of ring electrodes is defined as an axis, and then a normal b1 of a plane where any of the ring electrodes in the embodiment is located and a tangent line of the axis a1 at a center of the ring electrode form an included angle $\alpha$, and a range of the included angle $\alpha$ is (0, 90) degrees, that is the angle $\alpha$ is greater than 0 and less than 90 degrees. Preferably, the range of the included angle $\alpha$ is [5, 85] degrees, that is the angle $\alpha$ is equal to or greater than 5 and equal to or less than 85 degrees.

The spaces between neighboring ring electrodes may be equal or may not be equal.

A radio-frequency voltage source is used for applying an out-phase radio-frequency voltage on a neighboring ring electrode (for example, ring electrodes 101 and 102) along the axis a1, so that ions are confined inside the ring electrode during transmission.

The amplitudes of the applied radio-frequency voltages may be equal or may not be equal. When the amplitudes of the applied radio-frequency voltages are not equal, preferably, the amplitudes of the radio-frequency voltages are similar to better achieve ion focusing.

A direct-current voltage source is used for applying a direct-current voltage with an amplitude changing along the axis a1 on the ring electrode (for example, the ring electrodes 101 and 102), so that the ions are transmitted along the axis a1 and focused to a position closer to an inner surface of the ring electrode along a direction of the normal b1.

For positive ions, the direct-current voltage applied on the ring electrode along the axis a1 gradually decreases; and for anions, the direct-current voltage applied on the ring electrode along the axis a1 gradually increases.

Preferably, the amplitude of the direct-current voltage along the axis is changed in a nonlinear manner, or changed in a linear manner.

FIG. 2 shows a typical ring electrode constructing the ion guiding device of the present invention. The ring electrode is an annular metal sheet having a certain thickness, and the shape thereof is a quadrangle. Preferably, the shape of the ring electrode may be circular, oval or polygonal, such as triangle, square, rectangle, and pentagon, so long as an annular structure is constituted. The ion guiding device shown in FIG. 1 is constituted by disposing several ring electrodes shown in FIG. 2 in parallel.

To radially confining the ions, the ion guiding device of the present invention adopts a stacked ring electrode similar to an ion funnel, and applies a radio-frequency voltage on the ring electrode, so that a radial barrier is formed around a surface of the electrode. When moving around the electrode, the ions would be limited by a rebound effect of the radio-frequency voltage. In order to drive the ions radially, i.e., in a z direction, in the present invention, the direct-current voltage is applied on the ring electrode to generate an axial direct-current field. As an important feature of the present invention to be distinguished from the prior art, a normal of a plane where any of the ring electrodes is located and a tangent line of the axis at a center of the ring electrode form an included angle.

As shown in FIG. 1, an included angle $\alpha$ exists between a normal b1 of a plane where the ring electrode is located and a tangent line of the axis a1 at a center of the ring electrode. The included angle $\alpha$ ranges between (0, 90) degrees. Meanwhile, an out-phase radio-frequency voltage is applied between the ring electrodes 101 and 102 and every two successively neighboring ring electrodes along a z axial positive direction after the ring electrodes 101 and 102, to radially confine the ions. In addition, the direct-current voltage is applied between every two neighboring ring electrodes, so that a direct-current bias difference (a typical value, for example, of 4 V) exists between the neighboring ring electrodes. Since the tangent line of the axis a1 and the normal b1 have the included angle $\alpha$, in the potential distribution diagram of the xz section shown in FIG. 3(*a*), c indicates equipotential lines distributed on the ring electrode 201, the direct-current bias difference E between the neighboring ring electrodes has a direct-current electric field components Ez and Ex in the z axial direction and the x axial direction, the component Ez in the z axial direction enables the ions to move forwards along the z axis, and the component Ex in the x axial direction enables the ions to move in a direction deviating towards a negative direction of the x axis. In the potential distribution diagram of the xy section shown in FIG. 3(*b*), the xy section has a plurality of pairs of electrodes, the ions move along the negative direction of the x axis under the effect of the electric field component Ex of the negative direction of the x axis, and when the ions move closer to the surface of the electrodes, the ions are subjected to the rebound effect of the radio-frequency field. At this moment, the electric field component of the negative direction of the x axis has electric field components E// and E⊥ along a direction parallel to the electrodes and a direction vertical to the electrodes. The component E⊥ vertical to the electrodes balances with the rebound effect of the radio-frequency field, and the component E// parallel to the electrodes enables the ions to move along the negative direction of the x axis by means of closely the surface of the electrodes until all electric field components Ex of the negative direction of the x axis balance the rebound effect of the radio-frequency field. The ions finally would be compressed into a beam spot with a diameter of 1-2 mm to transmit by means of closely the surface of the ring electrodes.

As compared with the prior art, in the ion guiding device of the present invention, a radius of each ring electrode is identical, and the ions can be focused without a structure with a gradually reduced diameter. Only a set of ring electrodes, rather than a structure with two sets of ring electrodes coupled to each other, is required for off-axis transmission. Hence, the ion guiding device of the present invention can completely achieve functions of an ion funnel type device and ion guiding device of US patent US2011/0049357A1, and overcomes the defects of the two devices, i.e., unable to meet two functions at the same time, i.e., focusing and off-axis.

The existing ion funnels require to manufacture a ring with a changed diameter, which not only requires great efforts in manufacturing, but also has a higher requirement on accuracy. Moreover, it is more difficult for fixing. If a simple fixing is adopted, for example, four axes are fixed, a huge capacitance power consumption would be caused due to a large overlapped area between plates of the parts with reduced diameter Therefore, feasibility is unavailable. Moreover, for the ion guiding device disclosed in the previous US patent US2011/0049357A1, it not only requires to manufacture two sets (or more) of ring electrodes with different inner diameters and notches, but also requires to accurately couple the two sets of ring electrodes with different inner diameters. Therefore, angles of the notches of the two sets of ring electrodes and the assembly axis need to be accurately positioned, the manufacturing process is extremely complicated, and cleaning after use is also difficult. Upon comparison, the ion guiding device of the present invention greatly reduces manufacturing difficulty, and simplifies the manufacturing process. For example, when adopting an integral electrode manufacturing method in a Chinese Patent with an invention No. 201110425472.8 and entitled "Electrode Array And Manufacturing Method", the structure with equal diameter of the ion guiding device of the present invention may reduce difficulty in machining a groove, without processing a conical surface, and thus has excellent utility.

In addition, the ion guiding device of the present invention only requires a set of direct-current bias voltages to achieve axial and off-axis transmission of the ions at the same time, and the voltage applying mode is simple and flexible. By adjusting the direct-current bias voltage, the ion focusing position can be further adjusted. As shown in FIG. 4(*a*), ion trajectories under different direct-current bias voltage configurations can be obtained by simulation using SIMION ion trajectory simulation software. Different direct-current bias voltages have obvious differences on the function of focusing the ions. When the direct-current bias voltage is large, a bias voltage has a strong effect on the ions, and the deviating position of the ions in the z axial direction is small; on the contrary, when the direct-current bias voltage is small, the bias voltage has a weak effect on the ions, and the deviating position of the ions in the z axial direction is large. Taking the direct-current bias voltage as the x axis, and the deviating position as the y axis, a curve chart as shown in FIG. 4(*b*) can be obtained. Adjusting the deviating position of the ions in the axial direction can adjust the retention time of the ions in the ion guiding device. In multiple mass spectrometer analytical applications, positive and negative ions are required to be detected at the same time. When detecting the positive and negative ions, an ion source, the ion guiding device, and an analyzer have opposite voltage configurations. In order to rapidly detect the positive and negative ions, a voltage switching speed for the ion source, the ion guiding device, and the analyzer is required to be fast enough. Meanwhile, the retention time of ions therein is also required to be short enough. Hence, adjusting distribution of the direct-current bias voltage or direct-current bias voltage can obtain the ideal retention time of the ions in the ion guiding device, wherein the typical retention time is 400-500 microseconds.

Embodiment 2

FIG. 5 shows a structural schematic diagram of Embodiment 2 of the ion guiding device of the present invention. In this embodiment, at ion injection ends of the plurality of ring electrodes in Embodiment 1, a plurality of ring electrodes is disposed in parallel, a normal of a plane where any of the ring electrodes is located overlaps with a tangent line of the axis at a center of the ring electrode, and the disposed ring electrodes have the same size as the ring electrodes in Embodiment 1. Hence, in Embodiment 2, the normal of the plane where the ring electrodes are located overlaps with the z axis, and the connection line of the centers of the ring electrodes, i.e., the axis, is not a straight line. Specifically, an axis a5 overlaps with a normal b5 of the electrodes between the ring electrode 501 and the ring electrode 502, and therefore, an included angle between the normal b5 and the tangent line of the axis a5 at a center of the ring electrode is 0. An included angle $\alpha$ exists between an axis d and the normal b of the electrodes between the ring electrode 502 and the ring electrode 503. In the embodiment, the ions move along the axis under the effect of the electric field when entering the ion guiding device between the ring electrode 501 and the ring electrode 502, and deviate under the effect of the electric field after entering between the ring electrode 502 and the ring electrode 503.

The ion guiding device is generally disposed at a rear end of the ion injection device. The ions enter the ion guiding device through the ion injection device from atmosphere; airflow with ions discharges from the ion injection device, and then is subjected to vacuum adiabatic expansion, the speed of which can reach 3 to 6 times of sound speed. At this speed, the action time of a deviating force of the electric field on the ion is too short, so that the ions have a small deviating distance. Some ions have a probability to splat on the electrode due to the insufficient deviating distance, thereby reducing the transmission efficiency of the ions. The ion guiding device in this embodiment has an area for the ions to move along the axis; through this area, the speed of the airflow is reduced to subsonic speed, the action time of the deviating electric field on the ions is relatively long, and the deviating distance of the ions increases, thereby reducing the probability of the ion to splat on the electrode.

Preferably, the axis is any one of a straight line, curve or polygonal line.

Embodiment 3

As shown in FIG. 6, in the embodiment, the ring electrodes are divided into multiple sets. Specifically the ring electrode 601 and the ring electrode 602 are included in one set, and the ring electrode 602 and the ring electrode 603 are included in another set. Each set comprises at least two ring electrodes, and the included angle $\alpha$ formed by the axis and the normal in each set of ring electrodes changes. As shown in the drawing, the included angle formed by the tangent line of the axis a6 and the normal b6 in the left set of ring electrodes is $\alpha_1$, and the included angle formed by the tangent line of the axis a6' and the normal b6 in the right set of ring electrodes is $\alpha_2$.

Embodiment 4

As shown in FIG. 7, in the embodiment, the ring electrodes are divided into multiple sets, and each set comprises at least two ring electrodes. It can be known from the drawing that, the axis of the plurality of ring electrodes is curve, the included angle $\alpha$ formed by the tangent line of the axis and the normal of the ring electrodes differs along with different ring electrodes.

It should be noted that, the change of the value of the included angle $\alpha$ along the z axis may be various. As shown in FIG. 8, the change of the value of the included angle $\alpha$ along the z axis may be a constant (a=b=0), linear variation (a=0) or parabola variation ($a \neq 0$). The deviating force applied on the ions in the ion guiding device is related to the included angle $\alpha$. Hence, by changing the configuration of the included angle $\alpha$, the deviating position and degree of the ions can be configured in the ion guiding device.

Embodiment 5

As shown in FIG. 9, in the embodiment, in addition to the ion guiding device 901 consisting of the plurality of ring electrodes in the various embodiments above, it further comprises an ion injection device 902. The ion injection device 902 is a preceding stage of the ion guiding device 901, for example, it may be a metal capillary communicating with the atmosphere, for injection the ions generated by an ion source into the ion guiding device 901. Generally speaking, the ions are basically deviated and focused through the ion guiding device 901 according to a route c, and then passes through the ion ejection device 903, entering to the analyzing device 904 of a next stage. A neutral airflow basically passes through the device according to a route d, and is pumped by an air evacuation device such as a vacuum pump 905. Preferably, a port of the vacuum pump 905 may be arranged in a central axial direction of the ion guiding device 901; and the neutral components in the airflow would be ejected along the central axial direction, thereby achieving the off-axis transmission of the ions.

Embodiment 6

As shown in FIG. 10, in the embodiment, in addition to the ion guiding device 1001 consisting of the plurality of ring electrodes in the various embodiments above, it further comprises an ion ejection device 1003. Specifically, the ions enter the ion guiding device 1001 through an ion injection device 1002 along a normal direction of the electrode, then are compressed and focused, and then still enter the analyzing device 1004 of the next stage through the ion ejection device 1003 along the normal direction. The neutral components in the airflow is pumped by the vacuum pump 1005.

Embodiment 7

Regarding different ion injection directions, positions of the ion injection device and the ion ejection device can be flexibly set. As shown in FIG. 11(*a*), FIG. 11(*b*) and FIG. 11(*c*), the ions are respectively injected along a connection line of the centers of the ring electrodes, along the normal of the ring electrodes and along the direction vertical to the connection lines of the center of the ring electrodes, and the position of the ion injection device is also changed accordingly.

As shown in FIG. 11(*a*), the ions are injected along the direction of the connection line of the centers of the electrodes, and focused and deviated to exit from the vertical direction of the connection line of the centers of the electrodes. This mode may further remove the influence of the neutral components to improve signal-to-noise ratio.

As shown in FIG. 11(*b*) and FIG. 11(*c*), the ions still exit along the vertical direction of the connection line of the centers of the electrodes, but the injection direction is along the normal direction of the electrodes or along the vertical direction of the connection line of the centers of the electrodes. This mode can flexibly configure the injection and ejection positions of the ions, without influencing the ion off-axis transmission characteristics of the ion guiding device at the same time.

As shown in FIG. 12, the present invention further provides an ion guiding method, which comprises the following steps:

Steps 1, dispose a plurality of ring electrodes with a same size in parallel; defining a connection line of centers of the plurality of ring electrodes as an axis, and forming an included angle between a normal of a plane where any of the ring electrodes is located and a tangent line of the axis at a center of the ring electrode, wherein the range of the included angle is (0, 90) degrees.

Steps 2, apply an out-phase radio-frequency voltage on a neighboring ring electrode along the axis, so that ions are confined inside the ring electrode during a transmission process.

Steps 3, apply a direct-current voltage with an amplitude changing along the axis on the ring electrode, so that the ions are transmitted along the axis and focused to a position closer to an inner surface of the ring electrode along a direction of the normal.

Preferably, it further comprises: injection ions to the ion guiding device, and an included angle between an ion injection direction and the direction of the normal ranging between [0, 90] degrees.

Preferably, it further comprises: exiting focused ions from the ion guiding device, an included angle between an ion exiting direction and the direction of the normal ranging between [0, 90] degrees.

Preferably, it further comprises: disposing several ring electrodes at ion injection ends of the plurality of ring electrodes, wherein the several ring electrodes are disposed in parallel to the plurality of ring electrodes, and an included angle between a normal of a plane where the several ring electrodes are located and a tangent line of the axis at a center of the ring electrodes is 0 degree.

It should be noted that the structure of the ion guiding device related to the ion guiding method has the same characteristics as the above, and therefore, the structure is omitted for conciseness.

In view of the above, the ion guiding device and guiding method of the present invention, by disposing the plurality of ring electrodes with the same size in parallel and in an equal distance, ion focusing at a high air pressure or a low vacuum degree is effectively achieved; it also effectively removes neutral noises, greatly reduces difficulties in processing, manufacturing and assembling, and has strong utility. Therefore, the present invention effectively overcomes various defects in the prior art, and has a highly industrial value in use.

The aforementioned embodiments merely exemplarily illustrate the principal and effects of the present invention, but are not used for limiting the present invention. Any skilled person in this field can modify or vary the aforementioned embodiments without prejudice to the spirits and scope of the present invention. Hence, all equivalent modifications or variations made by a skilled person in this field without prejudice to the spirits and technical concepts disclosed in the present invention are still covered by the claims of the present invention.

The invention claimed is:

1. An ion guiding device, characterized by comprising:

a plurality of ring electrodes with a same size disposed in parallel, wherein a connection line of centers of the plurality of ring electrodes is defined as an axis, a normal of a plane where any of the ring electrodes is located and a tangent line of the axis at a center of the ring electrode form a first included angle, and a range of the first included angle is greater than 0 and less than 90 degrees;

a radio-frequency voltage source, for applying an out-phase radio-frequency voltage on a neighboring ring electrode along the axis, so that ions are confined inside the ring electrode during a transmission process; and a direct-current voltage source, for applying a direct-current voltage with an amplitude changing along the axis on the ring electrode, so that the ions are transmitted along the axis and focused off-axis to an inner surface of the ring electrode and an ions transmission direction and the axis form a second included angle, and a range of the second included angle is greater than 0 and less than 90 degrees.

2. The ion guiding device according to claim 1, characterized in that, the ring electrode is circular, oval or polygonal.

3. The ion guiding device according to claim 1, characterized in that, the axis is a straight line, curve or polygonal line.

4. The ion guiding device according to claim 1, characterized in that, the amplitude of the direct-current voltage is changed in a nonlinear manner along the axis.

5. The ion guiding device according to claim 1, characterized by further comprising: an ion injection device for injection ions to the ion guiding device, wherein an included angle between an ion injection direction and the direction of the normal ranges from 0 to 90 degrees.

6. The ion guiding device according to claim 1, characterized by further comprising: an ion ejection device for ejection focused ions from the ion guiding device, wherein an included angle between an ion exiting direction and the direction of the normal ranges from 0 to 90 degrees.

7. The ion guiding device according to claim 1, characterized by further comprising: an air pump device, for pumping neutral components around the plurality of ring electrodes.

8. The ion guiding device according to claim 1, characterized by further comprising: several ring electrodes disposed at upstream of the plurality of ring electrodes, wherein the several ring electrodes are disposed in parallel to the plurality of ring electrodes, and an included angle between a normal of a plane where the several ring electrodes are located and a tangent line of the axis at a center of the ring electrodes is 0 degree.

9. An ion guiding method, characterized by comprising the following steps:

disposing a plurality of ring electrodes with a same size in parallel; defining a connection line of centers of the plurality of ring electrodes as an axis, and a first included angle being formed between a normal of a plane where any of the ring electrodes is located and a tangent line of the axis at a center of the ring electrode, wherein a range of the first included angle is greater than 0 and less than 90 degrees;

applying an out-phase radio-frequency voltage on a neighboring ring electrode along the axis, so that ions are confined inside the ring electrode during a transmission process; and applying a direct-current voltage with an amplitude changing along the axis on the ring electrode, so that the ions are transmitted along the axis and focused off-axis to an inner surface of the ring electrode and an ions transmission direction and the axis form a second included angle, and a range of the second included angle is greater than 0 and less than 90 degrees.

10. The ion guiding method according to claim 9, characterized by further comprising: injection the ions to the ion guiding device, wherein an included angle between an ion injection direction and the direction of the normal ranges from 0 to 90 degrees.

11. The ion guiding method according to claim 9, characterized by further comprising: ejection the focused ions from the ion guiding device, wherein an included angle between an ion ejection direction and the direction of the normal ranges from 0 to 90 degrees.

12. The ion guiding method according to claim 9, characterized by further comprising: disposing several ring electrodes at upstream of the plurality of ring electrodes, wherein the several ring electrodes are disposed in parallel to the plurality of ring electrodes, and an included angle between a normal of a plane where the several ring electrodes are located and a tangent line of the axis at a center of the ring electrodes is 0 degree.

* * * * *